United States Patent [19]

Theurer

[11] Patent Number: 4,563,953

[45] Date of Patent: Jan. 14, 1986

[54] TAMPING HEAD WITH LIMITING STOP FOR TOOL RECIPROCATION

[75] Inventor: Josef Theurer, Vienna, Austria

[73] Assignee: Franz Plasser Bahnbaumaschinen-Industriegesellschaft mbH, Vienna, Austria

[21] Appl. No.: 491,027

[22] Filed: May 3, 1983

[30] Foreign Application Priority Data

Jul. 7, 1982 [AT] Austria ..... 2643/82

[51] Int. Cl.[4] ..... E01B 27/16

[52] U.S. Cl. ..... 104/12; 104/10; 92/13.1

[58] Field of Search ..... 104/7 R, 7 B, 10, 12; 92/13.1

[56] References Cited

U.S. PATENT DOCUMENTS

| | | | |
|---|---|---|---|
| 2,872,878 | 2/1959 | Plasser et al. | 104/12 |
| 3,357,366 | 12/1967 | Plasser et al. | 104/12 |
| 3,430,538 | 3/1969 | Weiss | 92/13.1 X |
| 3,608,498 | 9/1971 | Plasser et al. | 104/12 |
| 4,074,631 | 2/1978 | Theurer | 104/12 |
| 4,130,063 | 12/1978 | Theurer et al. | 104/12 |

FOREIGN PATENT DOCUMENTS 635891 2/1962 Canada .

*Primary Examiner*—Randolph A. Reese
*Attorney, Agent, or Firm*—Kurt Kelman

[57] ABSTRACT

A tamping head for a mobile track working machine comprises a tamping tool carrier vertically adjustably mounted on the machine, a vibratory tamping tool mounted on the carrier for immersion in a crib for pivoting towards and away from an adjacent tie in a reciprocating stroke between two end positions, a hydraulic drive for pivoting the tamping tool, the hydraulic pivoting drive including a cylinder element and a piston element, a reciprocating stroke limiting stop cooperating with the hydraulic pivoting drive for selectively adjusting a respective one of the end positions, and a hydraulic actuator for setting the stop for the selective adjustment of a respective end position, the hydraulic actuator including a cylinder element and piston element, one of the elements being movable in relation to the other element and the axes of the hydraulic pivoting drive and of the hydraulic actuator being parallel to each other, the hydraulic actuator being mounted on the hydraulic drive and the stop being constituted by the movable element.

6 Claims, 7 Drawing Figures

Fig.1
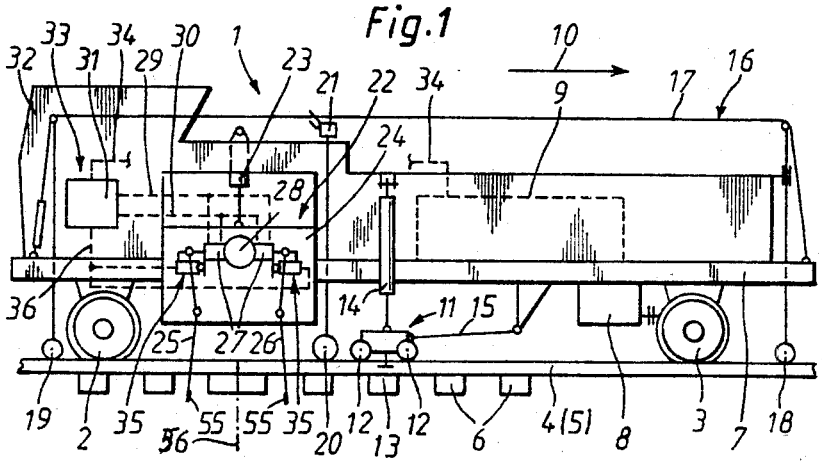
Fig. 2
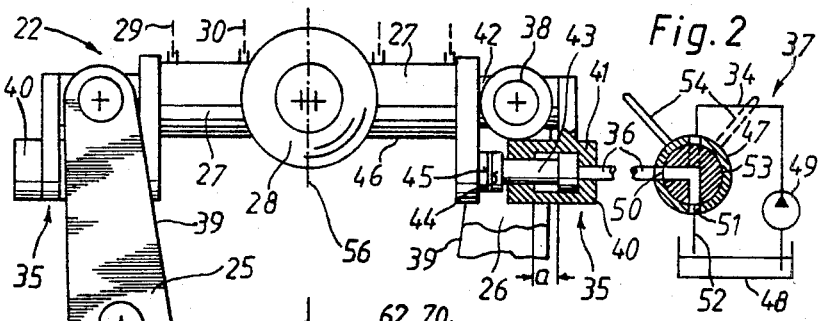
Fig. 4
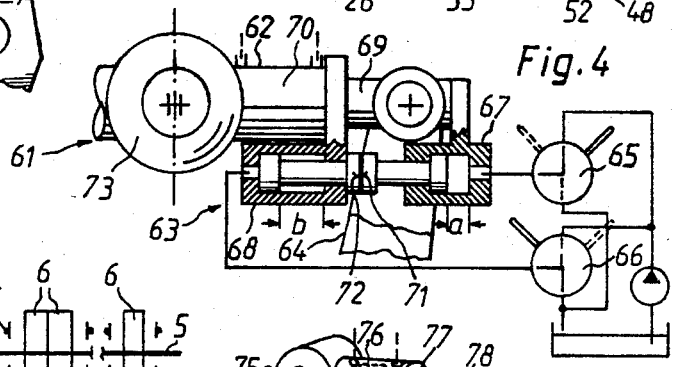
Fig. 3
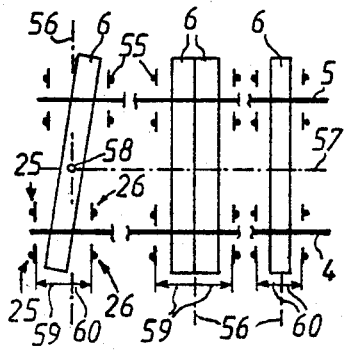
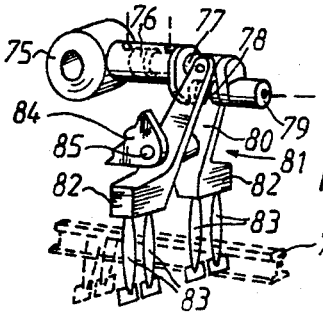
Fig.5

TAMPING HEAD WITH LIMITING STOP FOR TOOL RECIPROCATION

The present invention relates to a tamping head for a mobile track working machine arranged for tamping ballast underneath a respective one of a plurality of spaced ties resting on the ballast and having two track rails fastened thereto, the ties defining cribs therebetween, and more particularly to a tamping head comprising a tamping tool carrier vertically adjustably mounted on the machine, a vibratory tamping tool mounted on the carrier for immersion in a respective one of the cribs adjacent the respective tie and for pivoting towards and away from the tie in a reciprocating stroke between two end positions, and a hydraulic drive for pivoting the tamping tool, the hydraulic pivoting drive including a cylinder element and a piston element, and a reciprocating stroke limiting stop cooperating with the hydraulic pivoting drive for selectively adjusting a respective one of the end positions. Usually, a pair of such tamping tools are arranged for straddling the tie so that the reciprocating tools enclose the tie in a pincer movement between an open and a closed position.

A tamping head of this general type has been disclosed in U.S. Pat. No. 2,872,878, dated Feb. 10, 1959. In this tamping head, a cooperating pair of tamping tools is mounted on the tamping tool carrier and each tamping tool has its own double-acting hydraulic drive for pivoting the associated tool, each tool consisting of a two-armed lever pivotal about a centrally arranged fulcrum. The piston element of each drive has two coaxial, oppositely extending piston rods fixedly connected to the tamping tool carrier and the cylinder element is connected to an upper arm of the associated tool whose end is linked to a vibrating drive. A limiting stop may be pivoted into the path of the hydraulic drive cylinder element in the range of the outer end of the piston rod to select one of two end positions of the reciprocating stroke of each tamping tool. The limiting stop is a bell-crank lever pivotal about an axis extending in the direction of the track, the end of one arm of the lever partially encompassing the piston rod and forming the stop while the end of the other lever arm is linked to a hydraulic stop adjustment actuator having a cylinder whose one chamber selectively receives hydraulic fluid through a valve while a return spring is arranged in its other chamber. While this type of limiting stop enables the opening width of the cooperating tamping tools to be adapted to the most frequently encountered differences in crib widths and respective widths of single and double-ties, the required mechanical members and connecting links involve relatively high costs and take up considerable space, particularly in the direction of machine elongation. Furthermore, the pivoting of the limiting stop requires a relatively long time when compared to the time required for the other operating movements of the tamping tools.

U.S. Pat. No. 3,357,366, dated Dec. 12, 1967, discloses a tamping head with two pairs of cooperating tamping tools designed for the simultaneous tamping of two adjacent ties. A reciprocating stroke limiting stop is pivotal about an axis extending perpendicularly to the track, the stop being associated with the hydraulic pivoting drive of each outer tamping tool of each pair of tools for the selective setting of two different opening end positions. A double-acting hydraulic actuator is connected to each stop for pivoting the same. This made it possible for the first time to adapt the reciprocating strokes of cooperating pairs of tamping tools designed for the simultaneous tamping of two adjacent ties to different positions of the ties along the track. However, not all tamping head structures have enough space above the hydraulic pivoting drive for the tamping tools to accommodate the mechanical members of the limiting stop arrangement and its hydraulic fluid connecting lines. Furthermore, pivoting of the stop requires the prior outward move of the piston of the hydraulic pivoting drive since the paths of movement of the stop and of the free end of the piston rod of the hydraulic pivoting drive intersect.

Another such tamping head designed for the simultaneous tamping of two adjacent ties is disclosed in U.S. Pat. No. 4,130,063, dated Dec. 19, 1978. This arrangement permits the selection of four different opening widths for the two outer tamping tools of each pair of tools and includes two remote-controlled four-stage adjustment drives each connected to four hydraulic fluid lines, and these adjustment drives are arranged in a housing projecting from the tamping tool carrier in the direction of track elongation centrally between, and above, the track rails. A two-armed bearing body has one arm coupled to the cylinder of each four-stage adjustment drive and this body is glidably journaled on a guide extending in the direction of track elongation for movement in this direction by the adjustment drive, the other arm of the body being linked to the pivot of a respective outer tamping tool whose upper end is linked to the hydraulic pivoting drive for the tool. This structure involves relatively high manufacturing costs and complex controls. It also considerably increases the length of the tamping head in the direction of track elongation and the basic structure of existing tampers often does not provide sufficient space therefor. In addition, the unavoidable plays of the mechanical members add up to a total play which interferes with the accuracy of the set opening width of the tamping tools.

Canadian Pat. No. 635,891, dated Feb. 6, 1962, provides an arrangement for setting the opening width of reciprocating tampings tools for selecting two widths, in which the cylinder of the hydraulic pivoting drive for the tools not only has the two usual connections for selectively delivering hydraulic fluid to the two chambers of the cylinder for actuation of the drive but also has a third connection determining a smaller opening width of the tools, hydraulic fluid lines connecting all three connections to the output of a distributor with several control pistons. The distributor input is connected to a hydraulic fluid pump and a return sump for circulating the hydraulic fluid through the distributor to a respective cylinder chamber, a control lever being connected to the control pistons for sliding them into selected positions for directing the hydraulic fluid to the corresponding connections to select the desired opening width. This is an expensive structure for selecting only two opening widths and requires considerable space for the distributor and the many hydraulic connecting lines. Furthermore, this arrangement has the disadvantage of depending solely on hydraulic power for setting the selected reciprocating strokes of the tamping tools so that even minor leaks in the hydraulic systems will lead to an uncontrollable change in the desired opening width setting. The cost involved in the precision milling of the mating surfaces of contacting movable components of the distributor is excessive.

It is the primary object of this invention to improve a tamping head of the first-described type so as to provide a very simple and space-saving structure which, at the same time, will assure a precise and stable setting of the reciprocating stroke limiting stop for at least two selected end positions of the reciprocating stroke of the tamping tool, thus providing a device of great economy and operating dependability.

The above and other objects are accomplished in a surprisingly simple manner by the invention with a hydraulic actuator for setting the stop for the selective adjustment of a respective end position, the hydraulic actuator including a cylinder element and a piston element, one of the hydraulic actuator elements being movable in relation to the other element and the axes of the hydraulic pivoting drive for the tamping tool and of the hydraulic actuator 1 being parallel to each other. The hydraulic actuator is mounted on the hydraulic drive and the stop is constituted by the movable element thereof.

In this arrangement, the direction of adjustment of the reciprocating stroke limiting stop is the same as the direction of movement of the hydraulic pivoting drive so that no mechanical transmission members, such as levers, joints and the like, are required therebetween to move the stop in the selected position determining the width of the reciprocating stroke of the tamping tool. Since the adjustment of the stop is effected by a merely translatory displacement thereof by a distance determined by the dimensioning of the arrangement, the adjustment time is considerably reduced and the accuracy of the stop setting is very high. Furthermore, this hydraulic stop setting arrangement is not only structurally very simple and robust but also requires very little space, particularly in the direction of machine elongation because mounting of the hydraulic stop setting actuator directly on the hydraulic pivoting drive for the tamping tools makes it possible to use the otherwise empty space below the hydraulic pivoting drive for accommodating the stop with its setting actuator without interfering with the machine operator's free view of the tamping tools and other track working tools, such as track lining and lifting tools. There is no need for the multiplicity of hydraulic lines used in some of the conventional arrangements mentioned hereinabove, thus further enhancing the operator's view of the working tools. A tamping head equipped with this stop setting actuator makes it possible rapidly to change the desired opening widths of the reciprocatory tamping tools so that the operating cycle of the machine will be greatly reduced in a track section with irregular tie positions whereby the machine efficiency will be considerably improved. The arrangement is so simple that existing tamping heads may readily be retrofitted therewith at a minimum cost.

The above and other objects, advantages and features of the present invention will be more readily understood from the following detailed description of certain now preferred embodiments thereof, taken in conjunction with the accompanying, generally schematic drawing wherein FIG. 1 is a side elevational view of a mobile track working machine equipped with the tamping head of this invention;

FIG. 2 is an enlarged partial view of one embodiment of the tamping head of the machine of FIG. 1;

FIG. 3 is a diagrammatic top view illustrating the operation of the tamping head in a track section with ties of different width or positioning;

FIG. 4 is a view similar to that of FIG. 2 and showing another embodiment;

FIG. 5 is a perspective view showing yet another embodiment;

Figure 6:
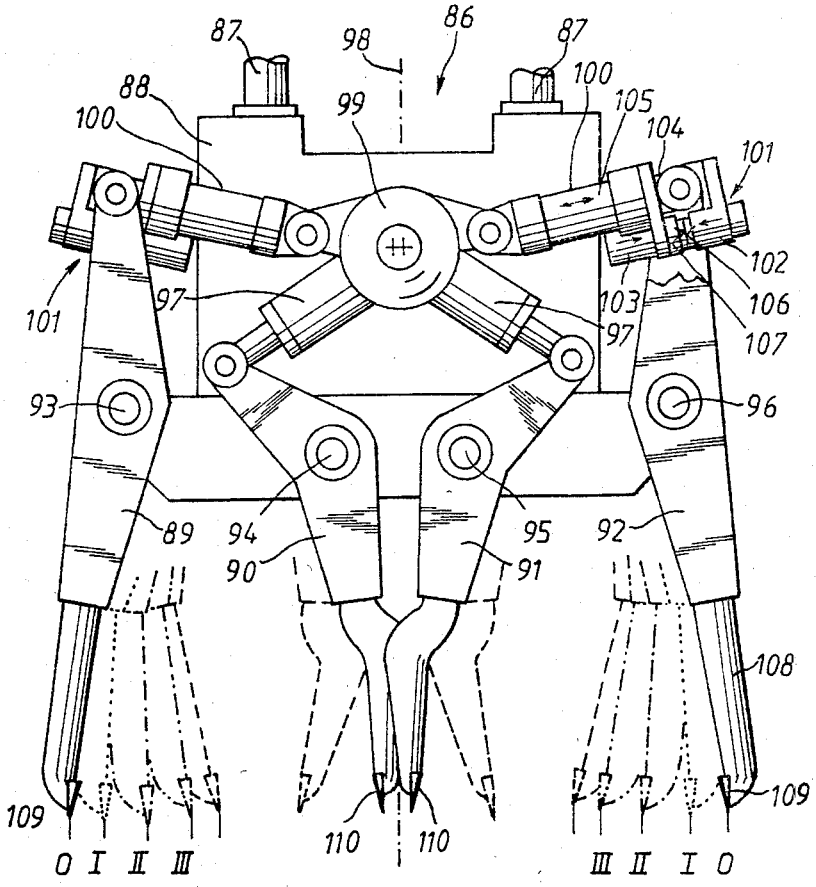
FIG. 6 is an enlarged side view of a tamping head with two pairs of tamping tools designed for the simultaneous tamping of two adjacent ties.

Referring now to the drawing and first to FIG. 1, the illustrated mobile track working machine is tamping, leveling and lining machine 1 comprising machine frame 7 mounted on undercarriages 2 and 3 for mobility on track rails 4, 5 fastened to a plurality of spaced ties 6 defining cribs therebetween and resting on ballast (not shown). The machine frame carries power plant 9 incorporating the usual power sources, such as drive motors, a current generator as well as supplies of hydraulic fluid and compressed air, and machine drive 8 connected to the wheels of undercarriage 3 for moving machine 1 in an operating direction indicated by arrow 10. As is also conventional, the machine is equipped with track lifting and lining tool unit 11 comprising lining rollers 12 guided along rails 4, 5 and lifting rollers 13 subtending each rail for engagement therewith. Lifting jack 14 links unit 11 to machine frame 7 and the unit is also linked to the machine frame by member 15 which pulls the lining and lifting unit along as the machine moves. Also conventionally, machine 1 has leveling reference system 16 comprised of respective tensioned reference wire 17 associated with each track rail 4, 5, a forward end of each reference wire being supported on track level sensing element 18 running on a track section whose level has not yet been corrected and a rear end of each tensioned reference wire being supported on track level sensing element 19 running on a leveled track section. Intermediate track level sensing element 20 trails lining and lifting tool unit 11 in the operating direction of the machine and carries measuring sensor 21, for example a rotary potentiometer, and this sensor cooperates with the respective tensioned reference wire for emitting a control signal corresponding to the difference between the actual and desired level of track rail 4 and 5, which signal controls the operation of jack 14. The machine also has a conventional lining reference system (not shown).

As is similarly conventional in track tampers, a tamping head 22 is associated with each track rail 4, 5 and each tamping head comprises tamping tool carrier 24 vertically adjustably mounted on machine 1 by means of jack 23 linking the carrier to machine frame 7. Two pairs of cooperating vibratory tamping tools 25, 26 are mounted on each side of the respective track rail on carrier 24 for immersion in a respective one of the cribs adjacent a tie extending between the tools and for pivoting towards and away from the tie in a reciprocating stroke between two end positions. The tamping tools are two-armed levers whose lower ends have tamping jaws 55 while the upper ends thereof are linked to hydraulic drive 27 for pivoting the tamping tools. The hydraulic drives are connected to central vibrating drive 28. The chambers of the cylinders of the double-acting hydrolic drives for the pairs of tamping tools 25, 26 are connected by hydraulic fluid lines 29, 30 with hydraulic fluid flow control valve arrangement 31 of central machine operating control 33 in operator's cab 32 of machine 1 and hydraulic line 34 connects the control valve arrangement to a hydraulic fluid supply in power plant 9. Each hydraulic pivoting drive 27 includes a cylinder element and piston element 42. All of the structure and the operations hereinabove described are essentially conventional and suitable structures of this type have been fully disclosed in the patents mentioned hereinabove. The mentioned U.S. patents also disclose a reciprocating stroke limiting stop cooperating with the hydraulic pivoting drive for selectively adjusting a respective one of the end positions.

The present invention provides hydraulic actuator 35 for setting the stop for the selective adjustment of a respective end position. The actuator illustrated in FIG. 2 is mounted on each hydraulic drive 27 for pivoting tamping tool 25, 26 for selectively setting the opening widths of the reciprocating tamping tools at two different end positions. Hydraulic fluid line 36 connects actuator 35 to control valve arrangement 31 at central control 33.

FIG. 2 shows one of the hydraulic actuators 35, together with a schematic showing of the associated hydraulic control circuit, in detail, the actuator mounted on the other hydraulic drive being identical. Tamping tools 25, 26 are comprised of a bifurcated pivotal tool holder arm 39 linked to hydraulic drive 27 by pivot 38, this structure being shown in FIG. 2 only fragmentarily and being fully explained hereinafter in connection with FIG. 5. For a better view and understanding of the hydraulic actuator, the part of the bifurcated tool holder arm 39 facing the viewer has been omitted in FIG. 2. In this simple embodiment of the invention, hydraulic actuator 35 is a simple cylinder-piston unit 40 whose cylinder element 41 is fixedly mounted on piston element 42 of hydraulic pivoting drive 27. The axes of the hydraulic pivoting drive and of the hydraulic actuator extend parallel to each other. Piston element 43 of the hydraulic actuator is shown in its retracted position and constitutes stop 44 for limiting the reciprocating stroke of the tamping tool by cooperating with hydraulic pivoting drive 27 for limiting its stroke for selectively adjusting a respective end position. In the illustrated embodiment, piston element 43 of hydraulic actuator 35 includes a piston rod having a free end extending from cylinder element 41 and cylinder element 46 of hydraulic drive 27 has abutment 45 fixedly connected thereto and arranged to cooperate with abutment 44 on the free piston rod end.

This very simple limiting stop actuator requires only a single additional hydraulic fluid line for operating the actuator since stop 44, when piston 43 is in its extended position, will simply be pushed into the cylinder from its extended end position into its retracted end position by cooperating abutment 45 when hydraulic fluid line 36 supplies no pressure to actuator cylinder 41 and hydraulic pivoting drive 27 is operated to move the tamping tool into its open position.

As highly schematically shown in FIG. 2, hydraulic control circuit 37 for actuator 35 may simply include three-way valve 47 in hydraulic line 36 and this valve forms one of the control valves in control valve arrangement 31 of FIG. 1. Hydraulic fluid line 34 connects the input of valve 47 to pump 49 for supplying hydraulic fluid from hydraulic fluid tank 48. One valve output 50 of valve 47 is connected to hydraulic fluid line 36 for supplying hydraulic pressure to one of the chambers of actuator unit 40 while another valve output 51 is connected to return line 52 to return hydraulic fluid to storage tank 48. Rotary adjustment element 53 of control valve 47 is movable by adjustment lever 54 between the positions indicated in full and broken lines. In the position indicated in full lines, the pressure chamber of actuator cylinder 41 is in communication with return line 52 so that hydraulic fluid flows from that cylinder chamber back into the storage tank, i.e. the actuator is not under pressure and cylinder 41 is free to be moved to bring piston 43 into the illustrated retracted position, stop 44 in the retracted position limiting further movement and setting one end position for a maximum opening width of tamping tool 26. When adjustment element 53 is in the position indicated in broken lines, hydraulic fluid supply line 34 is in communication with hydraulic fluid line 36 to supply pressure to the cylinder chamber and to move the cylinder so that piston 43 assumes its extended position which sets a second end position for the opening width of the tamping tool. The opening width of tamping tools 25, 26 is determined by the distance of tamping jaws 55 from median plane 56 (see FIG. 1) of the tamping head. In the illustrated maximum opening width, piston 42 of hydraulic pivoting drive is in its retracted position in cylinder 46. In the other setting of control valve 47, the hydraulic pressure in the cylinder chamber connected to line 36 will force cylinder 41 of actuator 35 outwardly by distance a in relation to piston 43 whose piston rod end 44 is held against abutment 45, piston 42 of hydraulic pivoting drive 27 moving outwardly by the same distance since cylinder 41 is fixedly mounted on this piston and control valve arrangement 31 is operated to supply no pressure to drive 27. This setting corresponds to a minimal opening width of the tamping tools when they are reciprocated by drive 27. Control valve arrangement 31 preferably comprises a separate three-way valve 47 for each hydraulic pivoting drive 27 so that desired opening widths may be set separately for tamping tool 25 and 26. Obviously, the illustrated three-way valve may be a functionally equivalent solenoid valve or the like. It will be advantageous, as illustrated, to connect the hydraulic pivoting drives and the hydraulic actuators to a common hydraulic fluid circuit although separate hydraulic pressure circuits could be used under special circumstances.

The schematic top view of FIG. 3 shows the operation of machine 1 in a track section with three different ties 6. Only tamping jaws 55 of tamping tools 25, 26 are schematically indicated in their immersed positions at both sides of track rails 4 and 5, and the drawing indicates the required opening end positions of the tamping tools for each of the ties. For tamping obliquely positioned tie 6 shown at the left in FIG. 3, machine 1 is moved into an operating position wherein common median plane 56 of the tamping heads respectively associated with rail 4 and 5 passes through center point 58 of the tie, which is located on center line 57 of the track intermediate the track rails. To enable ballast to be tamped uniformly under the tie by both tamping tools of each cooperating pair of tamping tools despite the oblique position of the tie, it is necessary to set the opening widths of the tamping tools associated with rail 4 so that tamping tool 25 has a maximum opening width, as shown by arrow 59, while the opening width of tamping tool 26 is set to its minimum, indicated by arrow 60. The reverse opening widths are set for the tamping tools associated with rail 5. Double tie 6 at a rail joint is shown at the center of FIG. 3 (see also FIG. 1) and the extra width of the tie requires all tamping tools to be set for maximum opening width, as indicated by arrows 59. With the correctly positioned simple tie 6 at the right side of FIG. 3, all tamping tools are set for minimum opening width, as indicated by arrows 60.

FIG. 4 illustrates another embodiment wherein tamping head 61 comprises hydraulic drive 62 including cylinder element 70 and piston element 69 for pivoting tamping tool 64. Hydraulic actuator 63 is designed for setting the stop for the selective adjustment of four different end positions of the reciprocating stroke of the tamping tool. The actuator comprises two coaxially arranged units 67 and 68 each including a cylinder element and a pivot element, the axes of the hydraulic actuator units being parallel to the axis of hydraulic drive 62. Unit 68 is fixedly connected to cylinder 70 of the hydraulic drive and the other unit 67 is fixedly connected to piston 69 of the hydraulic drive. The piston elements of units 67, 68 have free ends extending towards each other from the cylinder elements of the units and the free piston ends carry cooperating abutments 71, 72 constituting the stop which limits the reciprocating stroke of piston 69 of the hydraulic pivoting drive and, thus, the opening width of the tamping tool. Each actuator unit is connected to a separate three-way valve 65, 66 in the schematically illustrated hydraulic fluid circuit operating in a manner equivalent to that above described in connection with FIG. 2. To enable the stop to assume four stepped settings, the piston element of hydraulic actuator unit 68 has a reciprocating stroke of a length b exceeding length a of the reciprocating stroke of the piston element of the other unit 67, the illustrated stroke of the one unit being twice as long as that of the piston element of the other unit.

The provision of two cooperating hydraulic actuator units makes it possible to obtain at least three different end position settings by the selective application of hydraulic pressure to one or/and the other unit while maintaining a very accurate adjustment of the stop to the desired end position of the reciprocating stroke. With the illustrated dimensioning of the respective lengths of the reciprocating strokes of the piston elements of the hydraulic actuator units, four different end positions may be set, which will meet the requirements of practically all prevailing tie conditions. Therefore, such a tamping head will be substantially universally useful and will provide a very simple machine operation even in track sections where the width and/or the positioning of the ties changes frequently.

Since the usual hydraulic fluid supply and conduit system in track tampers of the described type normally used for the hydraulic pivoting drive of the tamping tools and other hydraulic operating tools has sufficient reserves for supplying the hydraulic actuators, too, the control valves for the actuators may simply be incorporated in control valve arrangement 31, as shown and described, without the need for further pumps or an increase in the hydraulic fluid storage capacity. All the operating elements can thus be controlled from a central control panel, as described.

Tamping head 61 of FIG. 4 will operate in the following manner during the tamping of a respective tie, the operation of the other embodiments proceeding in an equivalent manner:

After the tamping tools have been centered in relation to the tie under which ballast is to be tamped, three-way valves 65, 66 are actuated to produce the desired opening width of tamping tools 64. The tamping head is then lowered to immerse the tools in the ballast and vibrating drive 73 is operated to vibrate tamping tools 64 immersed at each longitudinal side of the tie to be tamped. Pressure is now applied to the inner cylinder chambers of pivoting drives 62 to move the pistons with piston rods 69 outwardly whereby stroke limitation abutments 71, 72 are moved apart. At the same time, the ballast is pressed by the tamping jaws at the lower end of tamping tools 64 under the tie and is there compacted until the desired and set degree of ballast compaction has been attained. Tamping head 61 is then raised and pressure is applied to the outer cylinder chambers of the pivoting drives to move the pistons with their piston rods inwardly. If the set opening width of the tamping tools is to be maintained for the next tamping cycle, the position of three-way valves 65, 66 remains unchanged so that the inward movement of the pistons with piston rods 69 is stopped as soon as abutments 71, 72 engage each other. However, if the tamping tools are to be returned to their maximum opening width, no pressure is applied to cylinder-piston units 67, 68 and the piston with the piston rod are fully moved inwardly while cylinder-piston unit 67 and 68 is simultaneously returned to its original position. The machine is then advanced to the next tamping point and the described operating cycle is repeated.

FIG. 5 illustrates a particularly simple and advantageous embodiment wherein tamping tool 81 is comprised of bifurcated pivotal tool holder arm 80 linked to hydraulic drive 76. The bifurcated tool holder arm straddles a respective one of track rails 74 and has two arm portions 82, 82 extending in opposite directions transversely to the track rail at each side thereof. Tamping tool implements 83 includes ballast tamping jaws mounted on each arm portion for immersion in the ballast at each side of the track rail. Pivoting drive 76 is linked to vibrating drive 75 and its piston rod 77 is connected through hydraulic actuator 79, which has reciprocating path limiting abutment 78, to tamping tool 81. Bifurcated tool holder arm 80 is mounted by pivot axle 85 extending transversely of rail 74 on tamping tool carrier 84 of which only a fragment is shown. In this manner, the setting of two discrete opening end positions of tamping tool implements 83 at both sides of the rail require only a single hydraulic actuator 79 and only a single reciprocating drive 76. This reduces the structural components of the arrangement to a minimum while it remains fully adaptable to different tie widths and crib widths as long as the ties are positioned more or less perpendicularly to the track rails.

FIG. 6 illustrates the application of the present invention to a conventional tamping unit 86 for simultaneously tamping two adjacent ties. Tamping tool carrier 88 is vertically adjustable along vertical guide columns 87 and pivot axles 93–96 extending transversely to the track pivotally mount four tamping tools 89–92 on each side of the rail at a longitudinal spacing from each other. Two adjacent tamping tools 89, 90 and 91, 92 are reciprocal in relation to each other and form a respective tamping tool pair for tamping ballast under a respective single or double tie. The two tamping tools 90, 91 designed for common immersion of their tamping jaws 110 in the center crib between the two adjacent ties to be tamped are linked by hydraulic pivoting drives 97 to vibrating drive 99 arranged in plane of symmetry 98 of tamping head 86 on tamping tool carrier 88. In this manner, pivoting drives 97 are capable of adjusting the positions of tamping tools 90 and 91 between the fixed opening end positions shown in full lines and the closing end positions shown in broken lines.

The two outer tamping tools 89 and 91 of the two pairs of tamping tools are linked to common vibrating drive 99 of tamping head 86 through respective pivoting drives 100 by built-on hydraulic actuators 101 whose axes are parallel to those of the pivoting drives to enable four discrete opening end positions of the tamping tools to be set selectively. As in the embodiment of FIG. 4, hydraulic actuator 101 comprises two coaxial cylinder-piston units 102, 103, unit 102 being fixedly connected to piston 104 and unit 103 being fixedly connected to cylinder 105 of pivoting drive 100. Here, again, the facing free ends of the piston rods of units 102, 103 determine the inner end position of piston 104 of the pivoting drive by abutments 106, 107. The selective application and relief of pressure in the hydraulic actuators may be effected in the manner of FIG. 4 or in any other suitable manner, for instance by remote-controlled valves. On the basis of the different reciprocating strokes of units 102, 103, as indicated by arrows, four different opening end positions may be set for tamping tools 89 and 92, as has been noted below the different positions of tamping tool implements 108 and tamping jaws 109 of tamping tools 89 and 92. Position 0 shown in full lines corresponds to the maximum opening position of the respective tamping tool. Opening end position I is shown in dotted lines and is obtained by applying pressure to unit 102. When pressure is applied only to unit 103, position II is obtained (shown in chain-dotted lines). The smallest opening position III is set by applying pressure to both units 102, 103. Finally, the closing end position reached by each tamping tool after its reciprocation has been indicated in broken lines.

Figure 7:
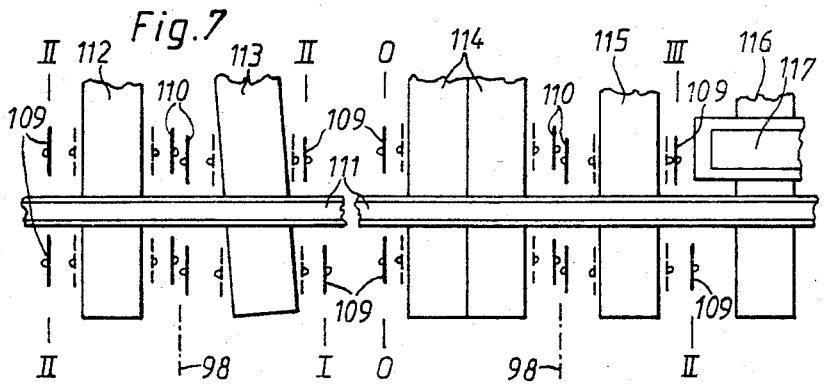
FIG. 7 is a diagrammatic top view similar to that of FIG. 3 and illustrating the operation of the tamping head of FIG. 6.

FIG. 7 schematically shows a partial top view of a track with irregularly positioned and/or dimensioned ties when tamped with tamping head 86 of FIG. 6. Only the points of intersection of rail 111 with several adjacent ties 112–116 of the track are illustrated as are tamping jaws 109, 110 of the tamping tools. The opening end positions of the reciprocating tamping tools are shown in full lines while their closing end positions are indicated in broken lines. Tamping of two adjacent ties 112, 113 is illustrated at the left side of FIG. 7, tie 113 extending obliquely rather than regularly, i.e. parallel to tie 112. The tamping head is so centered over these ties that its plane of symmetry 98 is substantially centered between the ties. For tamping ballast under regularly positioned tie 112, which extends perpendicularly to rail 111, it is sufficient to adjust the two tamping tools (jaws 109) at the left of the plane of symmetry to opening end position II. However, because of the oblique position of tie 113, the tamping tool (jaw 109) at the right of the plane of symmetry and laterally outside the track must be adjusted to wider opening end position I.

At the right side of FIG. 7, tamping of double tie 114 and adjacent, regularly positioned tie 115 is illustrated, an obstacle being constituted by housing 117 of an inductive signal emitter or the like at next adjacent tie 116. Here, tamping head 86 is centered with its plane of symmetry 98 between double tie 114 and regular tie 115. Because of the excess width of double tie 114, the two outer tamping tools left of the plane of symmetry must be adjusted to maximum opening end position 0. However, for tamping regular tie 115, it suffices to adjust the tamping tools to the right of the plane of symmetry to opening end position II. But housing 117 projecting towards tie 115 makes this adjustment impossible for one of these tamping tools and this is, therefore, adjusted to minimum opening end position III.

While the invention has been described and illustrated in connection with certain now preferred embodiments, it will be obvious to those skilled in the art that many structural variations and modifications are possible without departing from the spirit and scope of the present invention as defined in the appended claims. For example, the hydraulic actuator for setting the reciprocating stroke limiting stop of the tamping tools may be mounted coaxially on the pivoting drive, particularly on the end thereof facing the vibrating drive. This invention also provides special advantages in switch tamping machines with laterally upwardly pivotal tamping tools. In such machines, the setting of different reciprocating strokes for the tamping tools makes it possible to work on areas of the switch which would otherwise not be accessible to the tamping tools.

What is claimed is:

1. In a tamping head for a mobile track working machine arranged for tamping ballast underneath a respective one of a plurality of spaced ties resting on the ballast and having two track rails fastened thereto, the tie defining cribs therebetween, the tamping head comprising a tamping tool carrier vertically adjustably mounted on the machine, a vibratory tamping tool mounted on the carrier for immersion in a respective one of the cribs adjacent the respective tie and for pivoting towards and away from the tie in a reciprocating stroke between two end positions, and a hydraulic drive for pivoting the tamping tool, the hydraulic pivoting drive including a cylinder element and a piston element, and a reciprocating stroke limiting stop cooperating with the hydraulic pivoting drive for selectively adjusting a respective one of the end positions: a hydraulic actuator fixedly connected to one of the hydraulic drive elements for setting the stop for the selective adjustment of a respective end position, the hydraulic actuator including a cylinder element and piston element, the piston element of the hydraulic actuator including a piston rod having a free end extending from the cylinder element of the hydraulic actuator, the free piston rod end constituting the stop and the other hydraulic drive element having an abutment fixedly connected thereto and arranged to cooperate with the free piston rod end, the hydraulic actuator piston element being movable in relation to the cylinder element, the hydraulic pivoting drive and the hydraulic actuator having axes extending parallel to each other, and the hydraulic actuator being mounted on the hydraulic drive.

2. In the tamping head of claim 1, a common hydraulic fluid supply and conduit system for the hydraulic drive and the hydraulic actuator, and a control valve arrangement connecting the hydraulic drive and the hydraulic actuator to the fluid supply and conduit system.

3. In the tamping head of claim 1, the tamping tool being comprised of a bifurcated pivotal tool holder arm linked to the hydraulic drive, the bifurcated tool holder arm straddling a respective one of the track rails and having two arm portions extending in opposite directions transversely to the track rail at each side thereof, and tamping tool implements including ballast tamping jaws mounted on each arm portion for immersion in the ballast at each side of the track rail.

4. In a tamping head for a mobile track working machine arranged for tamping ballast underneath a respective one of a plurality of spaced ties resting on the ballast and having two track rails fastened thereto, the tie defining cribs therebetween, the tamping head comprising a tamping tool carrier vertically adjustably mounted on the machine, a vibratory tamping tool mounted on the carrier for immersion in a respective one of the cribs adjacent the respective tie and for pivoting towards and away from the tie in a reciprocating stroke between two end positions, and a hydraulic drive for pivoting the tamping tool, the hydraulic pivoting drive including a cylinder element and a piston element, and a reciprocating stroke limiting stop cooperating with the hydraulic pivoting drive for selectively adjusting a respective one of the end positions: a hydraulic actuator for setting the stop for the selective adjustment of a respective end position, the hydraulic actuator comprising two coaxially arranged units each including a cylinder element and piston element, one of the hydraulic actuator elements being movable in relation to the other element, the hydraulic pivoting drive and the hydraulic actuator units having axes extending parallel to each other, one of the units being fixedly connected to the cylinder element of the hydraulic drive and the other unit being fixedly connected to the piston element of the hydraulic drive, the piston elements of the units having free ends extending towards each other from the cylinder elements of the units and the free piston ends carrying cooperating abutments constituting the stop.

5. In the tamping head of claim 4, the piston element of the one unit having a reciprocating stroke of a length exceeding that of the reciprocating stroke of the piston element of the other unit whereby four different ones of said end positions may be selected.

6. In the tamping head of claim 5, the reciprocating stroke of the piston element of the unit being twice as long as that of the piston element of the other unit.

* * * * *